United States Patent [19]

Maag

[11] Patent Number: 4,840,373

[45] Date of Patent: Jun. 20, 1989

[54] FOUR-BAR RIGID-DRIVE VARIABLE RESISTANCE PECTORAL FLY MACHINE

[76] Inventor: Henry H. Maag, 5332 Clark Cir., Westminster, Calif. 92683

[21] Appl. No.: 172,550

[22] Filed: Mar. 24, 1988

[51] Int. Cl.[4] ..... A63B 21/00

[52] U.S. Cl. ..... 272/134; 272/117

[58] Field of Search ..... 272/117, 118, 134, 130, 272/138

[56] References Cited

U.S. PATENT DOCUMENTS

| | | | |
|---|---|---|---|
| 3,640,527 | 2/1972 | Proctor | 272/134 |
| 3,912,261 | 10/1975 | Lambert, Sr. | 272/134 |
| 4,336,934 | 6/1982 | Hanagan et al. | 272/117 |
| 4,357,010 | 11/1982 | Telle | 272/117 |
| 4,494,751 | 1/1985 | Schnell | 272/134 |
| 4,505,475 | 3/1985 | Olschansky et al. | 272/118 |

*Primary Examiner*—Richard J. Apley

*Assistant Examiner*—J. Welsh

[57] ABSTRACT

A shoulder-joint horizontal-flexion exercise machine (pec-deck or pectoral fly machine) which applies a predetermined variably resistive force to an operator's shoulder-joint horizontal-flexion muscles through the use of a kinematically derived double-rocking-lever four-bar linkage, whose rocking follower lever constitutes a rotating weight arm to which weights are loaded, and whose rocking driver lever is mechanically linked, through rigid connecting rods, to a pair of offset rigid counter-rotating assemblies which rotate on axes which are approximately common with the vertical axes through the operator's shoulder joints. These counter-rotating assemblies contain body-machine force-transmitting contact surfaces which engage the operator's upper arms and apply resistive force to the same through circular paths about the vertical axes of rotation of the operator's shoulder joints.

1 Claim, 4 Drawing Sheets

FOUR-BAR RIGID-DRIVE VARIABLE RESISTANCE PECTORAL FLY MACHINE

This invention relates to exercise equipment, in particular to a shoulder-joint horizontal-flexion exercise machine (pec-deck or pectoral fly machine) which utilizes only rigid drive members and pinned joints to apply a predetermined variably resistive force to an operator's chest and frontal shoulder muscles throughout the range of the exercise movement. BACKGROUND AND OBJECTIVE OF THE INVENTION Present day pectoral fly machines all work on the same primary principle of fixing the positions of the operator's shoulder joints while applying resistive forces to the operator's upper arms which tend to make the upper arms rotate about their respective shoulder joints, through a transverse plane relative to the operator's upper body, in the direction of horizontal extension of the shoulder joints. The pectoral muscles of the chest and the frontal deltiod muscles of the shoulders are developed as they oppose these forces by tending to rotate the upper arms about their respective shoulder joints, through a transverse plane relative to the operator's upper body, in the direction of horizontal flexion of the shoulder joints.

It is a well known fact and easily verified that due to joint mechanics, angles of pull of muscles, physiological make-up of muscles, etc. less force can be applied in a shoulder-joint horizontal-flexion movement as the shoulders horizontally flex the upper arms closer together in front of the chest. Consequently, a machine which varies the resistive force applied to correspond with the positionally related strength capabilities of an operator's shoulder-joint horizontal-flexion muscles will be more effective at developing those muscles.

The standard method of varying the resistive force applied on present day pectoral fly machines is through the use of cams used in conjunction with chains or cables, all of which have inherent problems. The problem with cams is that they are relatively hard to manufacture. The problem with cables is that, because of their relatively small cross-sectionl area, they carry very high tensile stresses (a ⅜" cable carrying 200 lbs, for example, has a tensile stress in it of approximately 16,300 psi). These already high stresses are multiplied and become cyclic (introducing fatigue wear) when a cable moves along bending back and forth over a small diameter pully. These high cyclic stresses, applied to relatively small cross-sectional areas, cause cables to stretch (eventually decreasing the machine's intended range of motion) and eventually fray and wear out (leading to replacement or catastropic failure). Chains, while not suffering the fatigue wear that cables do, are subject to stretching at their many joints (thus decreasing the machine's intended range of motion). They, also like cables, are subject to relatively high tensile stresses and in addition are noisy and introduce spurious drag to the machine.

In view of the advantage of applying a variably resistive force to an operator's shoulder-joint horizontal-flexion muscles during a pectoral fly exercise movement which varies in accordance with the operator's strength-to-position force-applying capabilities throughout the movement, and the disadvantages of obtaining such a force through the use of cams, chains, or cables, it is the objective of the disclosed invention to introduce a pectoral fly exercise machine which applies a predetermined variably resistive force to an operator's shoulder-joint horizontal-flexion muscles through the use of a force-varying mechanism which uses only rigid members and pinned joints, thereby eliminating the problems associated with force-varying mechanisms using cams, chains, or cables.

SUMMARY OF THE INVENTION

The invention consist of a stable frame which contains subject positioning means which supports an operator in a slightly inclined seated position with his back constrained from backward movement. Journaled in this frame, on axes which are approximately common with the vertical axes of rotation of the operator's shoulder joints while in the seated operating position, are a pair of rigid counter-rotating upper arm engaging assemblies. Attached to these counter-rotating upper arm engaging assemblies are upper arm engaging contact surfaces which engage the operator's upper arms and serve the function of applying resistive force to the operator's upper arms through circular paths about the vertical axes of rotation of the operator's shoulder joints. Journaled in the machine's frame, on an axis which is both perpendicular to the axes of rotation of the two counter-rotating upper arm engaging assemblies and generally parallel with the ground plane, is a rotating effort arm which is mechanically linked to the two counter-rotating upper arm engaging assemblies through the use of a pair of connecting links which join between pivotal points of connection on the rotating effort arm which move through arcs which approximate the plane which the pivotal points of connection on the respective counter-rotating upper arm engaging assemblies move through throughout the exercise movement. Also journaled in the machine's frame on an axis which is both parallel with and offset by a specific distance from the axis of rotation of the rotating effort arm is a rotating weight arm which contains provision for loading weights onto at a point offset from its axis of rotation. The rotating effort arm and the rotating weight arm are mechanically linked to each other at axes which are both parallel with and offset by specific distances from their respective axes of rotation by a rigid connecting link which also has a specific length between its centers of connection. The rotating effort arm, the rotating weight arm, the link joining them, and the frame of the machine join together to form a double-rocking-lever four-bar linkage which acts in conjunction with the rotating weight arm and the crank and slider type linkages (constituted by the counter-rotating upper arm engaging assemblies and the connecting links connecting them to the rotating effort arm) to vary the resistive force applied to the operator's shoulder-joint horizontal-flexion muscles through body-machine contact with the counter-rotating upper arm engaging assemblies throughout the exercise movement. Through a simple kinematic analysis the specific lengths and orientations of the moving parts which constitute the double-rocking-lever four-bar linkage and the moving parts which constitute the crank and slider type linkages which are connected in series to the double-rocking-lever four-bar linkage can be specified to apply a load, at the upper arm engaging contact surfaces on the counter-rotating upper arm engaging assemblies, which varies in accordance with the normal strength-to-position force-applying capabilities of the average operator in the shoulder-joint horizontal-flexion exercise movement.

This invention, through the use of a kinematically derived and specified four-bar linkage with rotating weight arm acting in conjunction with a pair of crank and slider type mechanisms which together use only rigid members and pinned joints, applies a predetermined variably resistive force to an operator's shoulder-joint horizontal-flexion muscles throughout the range of the exercise movement without the use of cams, chains, or cables, thereby fulfilling its objective.

DESCRIPTION OF THE PREFERRED EMBODIMENT

Figure 1:
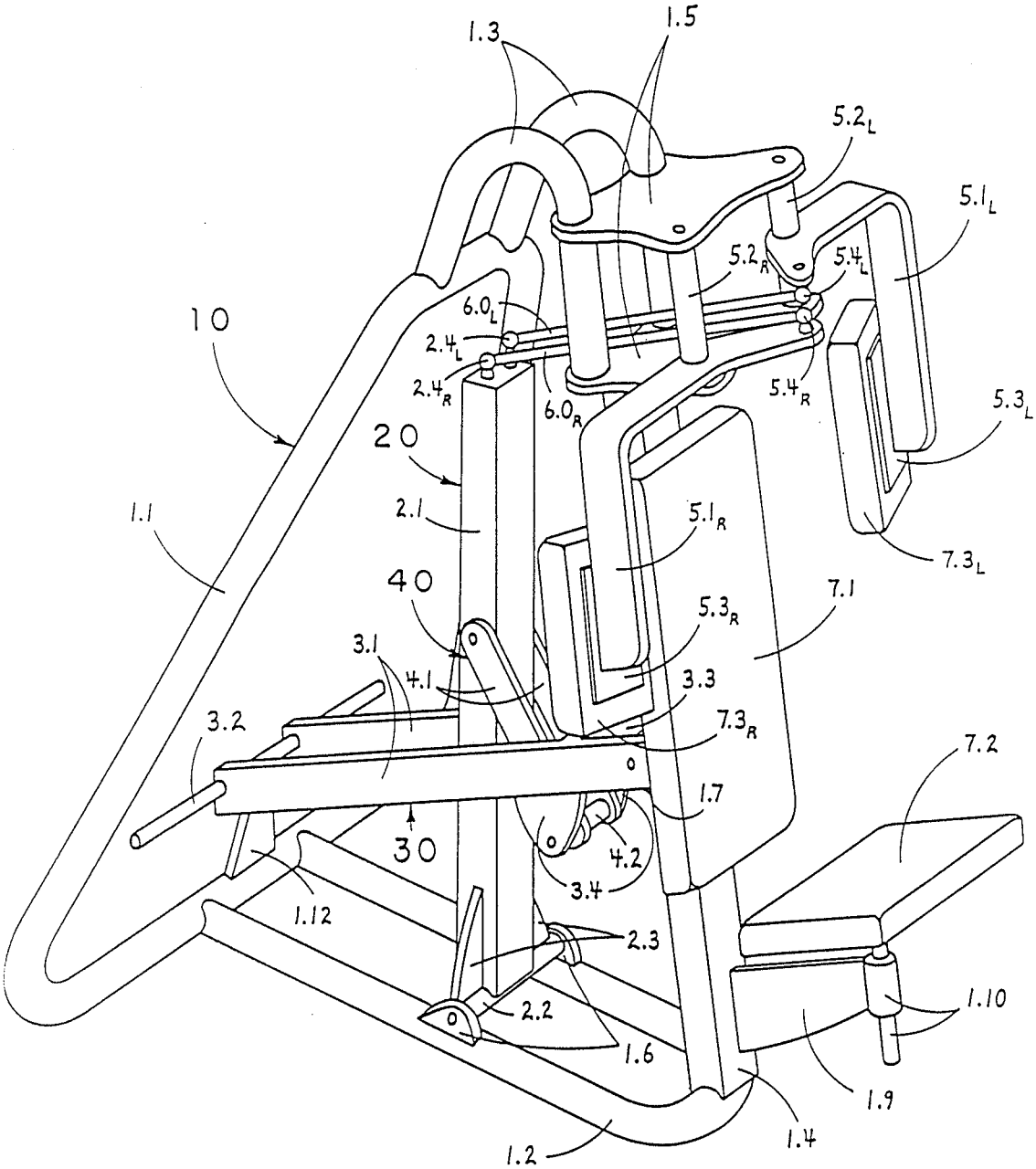
FIG. 1 is a pictorial view of the preferred configuration embodiment of the disclosed shoulder-joint horizontal-flexion exercise machine with all parts labeled.
Figure 2:
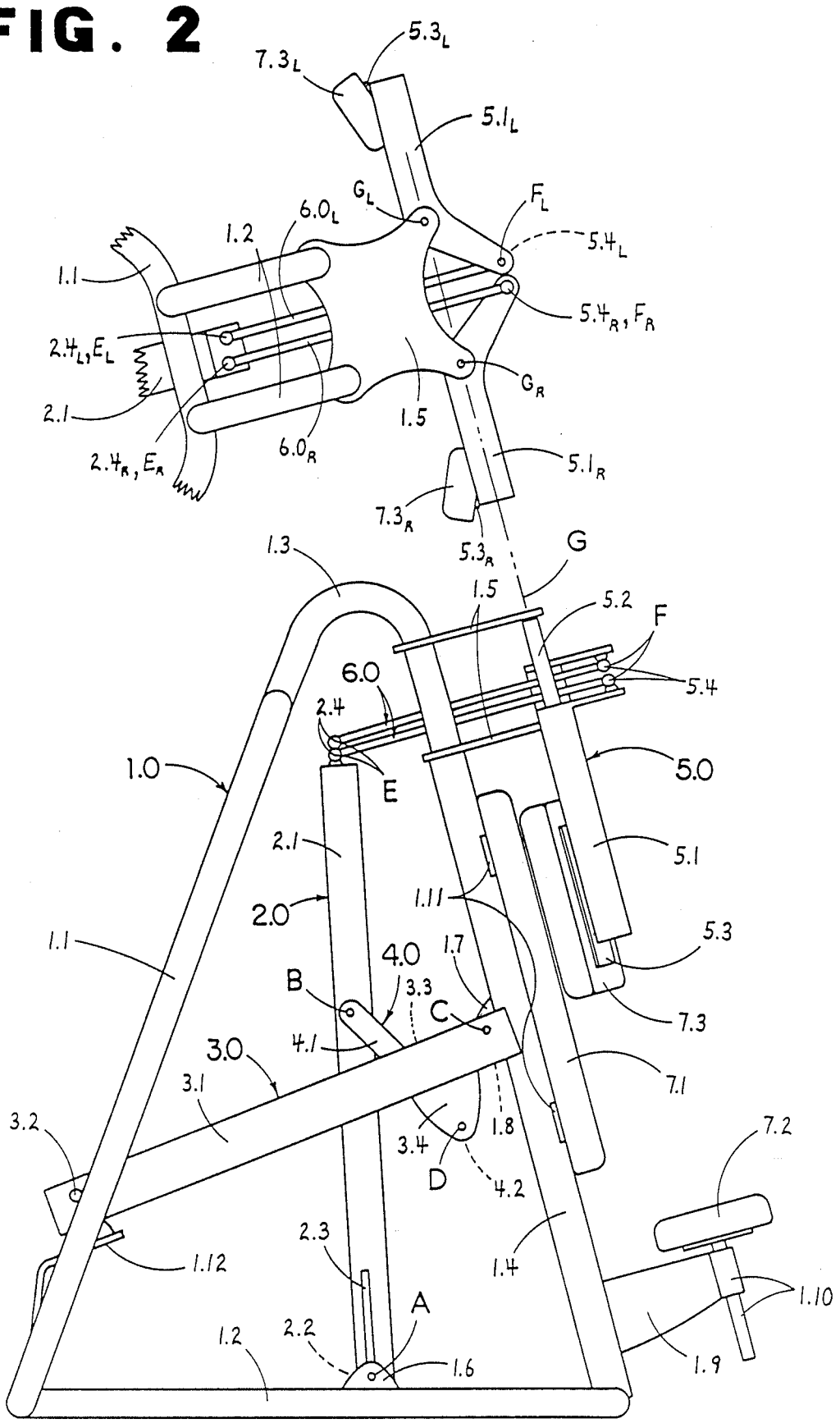
FIG. 2 is a side view taken perpendicular to the plane which the machine's four-bar linkage and rotating weight arm lie in and includes a section view taken perpendicular to the plane which the machine's crank and slider type mechanisms lie in with all parts labeled.

Refer now in detail to FIGS. 1 & 2 which show corresponding pictorial and side views of the disclosed invention. The primary frame of the invention (assembly 1.0) consist of four round steel tubing loops, two flat steel plates, and one straight rectangular steel tube. The first round steel tubing loop (part 1.1) forms a closed trapezoidally shaped loop which is both symmetrical about the machine's plane of symmetry and lies in a plane which forms approximately a 70° angle with the ground. The second round steel tubing loop (part 1.2), which lies on the ground plane in a position symmetrical about the machine's plane of symmetry, forms a "U" shaped half loop which joins into part 1.1 at its open ends on the ground plane at the back of the machine where the planes which these two loops (parts 1.1 & 1.2) lie in intersect. The last two round steel tubing loops (parts 1.3), which are both identical in their inverted "J" shape, lie in parallel planes which are both parallel with and symmetrical about the machine's plane of symmetry and separated by about 10". The shorter rearward leg of each of these two parallel "J" shaped round steel tubes (parts 1.3) lies in the plane of part 1.1 and joins into the top of part 1.1 at its open end. The lower forward leg of each of these two parallel "J" shaped tubes lies in the plane of part 1.4 which passes through the forward end of part 1.2 on the ground plane as shown, so that parts 1.1, 1.2, 1.3 & 1.4 form a triangle when viewed from the side, as shown in FIG. 2. As shown in FIGS. 1 & 2, the forward legs of parts 1.3 each extend down through the upper of a pair of parallel flat steel bearing plates (parts 1.5) where they join into the top side of the lower of the pair of parallel flat steel bearing plates (parts 1.5) at their open ends. As shown in FIGS. 1 & 2, a straight rectangular steel tube (part 1.4) lies on the machine's plane of symmetry where it joins into the forward end of the "U" shaped round steel tubing loop (part 1.2) at its lower end, and the bottom side of the lower of the two parallel steel bearing plates (parts 1.5) at its upper end. These five steel tubes and two steel plates join to form a simple, stable frame for the disclosed invention when welded together as shown and described.

Attached flush to the forward side of part 1.4 in a position centered on the machine's plane of symmetry by four steel tabs (parts 1.11) is an operator back support and constraint pad (part 7.1). Just below part 7.1, in a position also centered on the machine's plane of symmetry is an adjustable seat support pad (part 7.2) which is mounted to a screw-type mount (part 1.10) which is joined to the machine's frame at the base of part 1.4 by a steel bracket (part 1.9) as shown.

Figure 3:
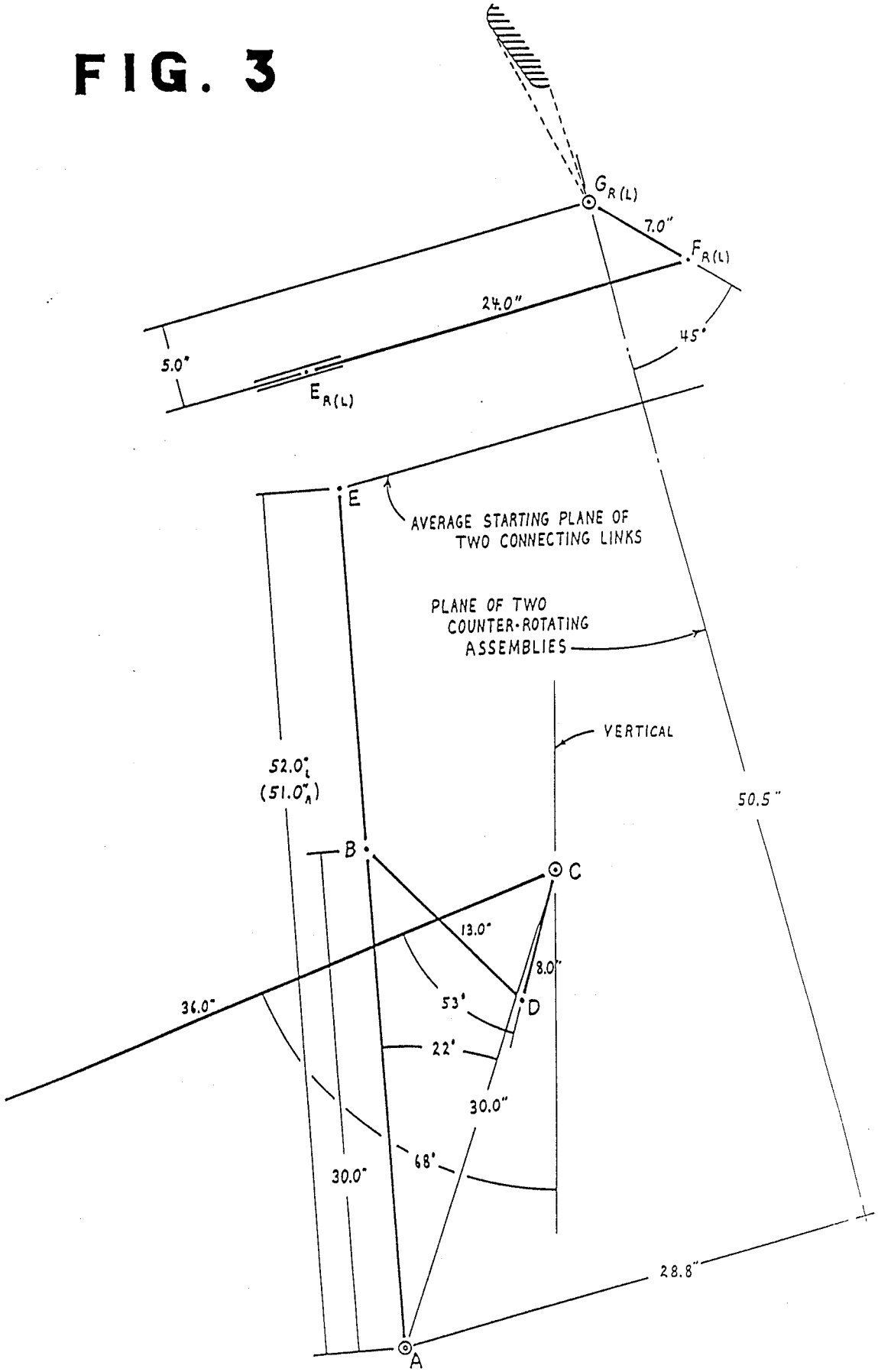
FIG. 3 is a kinematic view of the machine's moving parts showing all critical dimensions and angles at the starting position of the exercise movement.

Journaled in the outer forward ends of the parallel bearing plates (parts 1.5) on parallel axes (axes $G_R$ & $G_L$) which are symmetrical about the machine's plane of symmetry, separated by 12.0", and positioned relative to the operator back support pad (part 7.1) so as to correspond approximately with the vertical axes of rotation of the average operator's shoulder joints when in the operating position, are a pair of rigid counter-rotating upper-arm engaging assemblies (assemblies $\mathbf{5.0}_R$ & $\mathbf{5.0}_L$). The two assemblies (assemblies $\mathbf{5.0}_R$ & $\mathbf{5.0}_L$) are both symmetrical with each other and are each composed of an inverted "L" shaped bracket (part $\mathbf{5.1}_R$ ($\mathbf{5.1}_L$)) whose upper horizontal leg mounts a bearing tube (part $\mathbf{5.2}_R$ ($\mathbf{5.2}_L$)) which lies on and journals the respective assembly's bearings to the respective assembly's axis of rotation (axis $G_R$ ($G_L$)), and whose downardly extending vertical leg is both parallel with and offset by approximately 12" from the respective assembly's axis of rotation established by its bearing tube (part $\mathbf{5.2}_R$ ($\mathbf{5.2}_L$)). Welded to the lower rearward side of each downwardly extending vertical leg is a pad mounting plate (part $\mathbf{5.3}_R$ ($\mathbf{5.3}_L$)) which mounts an upper arm engaging pad (part $\mathbf{7.3}_R$ ($\mathbf{7.3}_L$)) which engages the inside of the operator's corresponding right or left upper arm at the beginning of the exercise movement in a position approximately 20° behind the plane of the two counter-rotating assemblies, as shown in FIGS. 2 & 3. As shown in the section cut at the top of FIG. 2, a connecting rod ball-joint mount (part $\mathbf{5.4}_R$ ($\mathbf{5.4}_L$)) is attached to each counter-rotating assembly at the inside end of the upper horizontal leg of part $\mathbf{5.1}_R$ ($\mathbf{5.1}_L$) in a position where its center of connection (axis $F_R$ ($F_L$)) is 7.0" off of the respective assembly's axis of rotation (axis $G_R$ ($G_L$)) and 45° forward of the plane of the two counter rotating assemblies (established by axes $G_R$ and $G_L$) at the beginning of the exercise movement, as shown in FIG. 3. As shown in the side view in FIG. 2, these two connecting rod ball-joints are vertically offset by approximately 2" in order to allow connecting rod clearance while performing the exercise.

Centered on the machine's plane of symmetry is a rigid rotating effort arm assembly (assembly 2.0) which rotates about an axis (axis A) which is perpendicular to the machine's plane of symmetry and located in a position which, as shown in FIG. 3, is 50.5" below the average starting plane of the two connecting rods (parts $\mathbf{6.0}_R$ & $\mathbf{6.0}_L$) directed down the plane of the two counter-rotating assemblies (established by axes $G_R$ & $G_L$) and 28.8" behind the plane of the two counter-rotating assemblies. This rotating effort arm assembly (assembly 2.0) is journaled to the machine's frame in bearings which are centered on axis A in frame-attached flanges (parts 1.6) which are located on the top sides approximately in the centers of the two legs of part 1.2, as shown in the side view in FIG. 2. As shown in FIGS. 1 & 2, this assembly is composed primarily of a straight rectangular steel tube (part 2.1) which lies on the machine's plane of symmetry. Centered on the assembly's plane of symmetry and perpendicularly joined to the bottom end of this rectangular steel tube (part 2.1) is a bearing tube (part 2.2) which lies on and journals the assembly's bearings to the assembly's axis of rotation (axis A). Reinforcing braces (parts 2.3) are welded into the corners just above each side of the bearing tube (part 2.2) where it joins into part 2.1. Attached to the upper (distal) end of part 2.1 are a pair of connecting rod ball-joint mounts (parts $\mathbf{2.4}_R$ & $\mathbf{2.4}_L$). These ball-joint mounts are mounted in positions which are offset to each side of the assembly's plane of symmetry by 1.0", making the respective axes of rotation of the respective right and left counter-rotating assemblies offset by 5.0" from the respective lines which these respective ball-joint mounts move along throughout the exercise movement when viewed from the top, as shown in FIG. 3. The right ball-joint (part $\mathbf{2.4}_R$) is located 51.0" from the assembly's axis of rotation (axis A) and the left ball-joint (part $\mathbf{2.4}_L$) is located 52.0" from the assembly's axis of rotation (axis A), as shown in FIG. 3. This assembly (assembly 2.0) is mounted to its bearings by a steel pin which is centered on the assembly's axis of rotation (axis A) in the bearings which are journaled in part 2.2 as described above. Parallel to and offset from the assembly's axis of rotation by a distance of 30.0", as shown in FIG. 3, is a second axis (axis B). This second axis (axis B), which journals a second steel pin which is used in connecting a connecting link from the rotating effort arm assembly (assembly 2.0) to the rotating weight arm assembly (assembly 3.0), is centered in bearings which are journaled in part 2.1 on the line connecting the assembly's axis of rotation (axis A) with the axes of connection (axes $E_R$ & $E_L$) of the ball-joints (parts $\mathbf{2.4}_R$ & $\mathbf{2.4}_L$).

As shown in FIGS. 1 & 2, the rotating effort arm assembly (assembly 2.0) and the respective right and left counter-rotating upper arm engaging assemblies (assemblies $\mathbf{5.0}_R$ & $\mathbf{5.0}_L$) are mechanically linked to each other by the respective right and left connecting rods (parts $\mathbf{6.0}_R$ & $\mathbf{6.0}_L$). The forward end of each respective connecting rod connects to its respective counter-rotating assembly at the respective ball-joint mount (part $\mathbf{5.4}_R$ ($\mathbf{5.4}_L$), axis $F_R$ ($F_L$)), as shown in FIGS. 1 & 2. The rearward end of each respective connecting rod connects to its respective ball-joint mount (part $\mathbf{2.4}_R$ ($\mathbf{2.4}_L$), axis $E_R$ ($E_L$)) at the upper end of the rotating effort arm assembly. The two connecting rods (parts $\mathbf{6.0}_R$ & $\mathbf{6.0}_L$) are identical and have lengths of 24.0" between centers of connection, as shown in FIG. 3.

Centered on the machine's plane of symmetry is a rigid rotating weight arm assembly (assembly 3.0) which rotates about an axis (axis C) which is parallel with the axis of rotation of the rotating effort arm assembly (assembly 2.0, axis A). This rotating weight arm assembly (assembly 3.0) is journaled in bearings which are centered on axis C in a bearing tube (part 1.8) which is attached approximately midway up the back side of part 1.4 by frame-attached flanges (parts 1.7). The distance between the rotational axes of these two rotating assemblies (assemblies 2.0 & 3.0) is 30.0" and the direction to axis C from axis A is upward and forward along a line which forms a 22° angle with the line connecting axis A with axes E at the beginning of the exercise movement, as shown in FIG. 3. The rotating weight arm assembly (assembly 3.0) is, like the rotating effort arm assembly (assembly 2.0), symmetrical about the machine's plane of symmetry. It is composed primarily of two parallel rectangular steel tubes (parts 3.1) which are symmetrical about the assembly's plane of symmetry and separated by approximately 8" so as to allow the rotating effort arm and the connecting link assembly joining the rotating effort arm to the rotating weight arm to pass between them throughout the exercise movement. Attached to the distal ends of these two parallel rectangular steel tubes (parts 3.1) and lying in a line which is both parallel with and offset from the assembly's axis of rotation (axis C) by a distance of 36.0" is a weight support bar (part 3.2) which extends outward approximately 12" to each side of each respective rectangular steel tube (part 3.1). This assembly (assembly 3.0) is mounted to its bearings by a steel pin which is centered on the assembly's axis of rotation (axis C) in bearings which are journaled in the forward ends of parts 3.1 as shown. Parallel to and offset from the assembly's axis of rotation by a distance of 8.0" is a second axis (axis D) which journals a second steel pin which is used in connecting the connecting link assembly mentioned earlier from the rotating effort arm assembly (assembly 2.0) to the rotating weight arm assembly (assembly 3.0). This second axis (axis D) is centered in bearings which are journaled in a pair of parallel steel flanges (parts 3.4) which are welded to the lower forward sides of parts 3.1 as shown. The angle formed between the line connecting the axis of the weight support bar with the assembly's axis of rotation (axis C) and the line connecting axis D with the assembly's axis of rotation (axis C) is 53°, as shown in FIG. 3.

As shown in FIGS. 1 & 2, the rotating effort arm assembly (assembly 2.0) and the rotating weight arm assembly (assembly 3.0) are mechanically linked to each other by a connecting link assembly (assembly 4.0). This connecting link assembly is composed of two parallel flat steel bars (parts 4.1) which are separated by approximately 5" so as to allow the rotating effort arm assembly to pass between them and the rotating weight arm assembly to pass outside of them while performing the exercise. These two parallel flat steel bars (parts 4.1) are joined to a bearing tube (part 4.2) at their lower forward ends and have bearing holes drilled in their upper rearward ends which lie on an axis which is parallel with the axis down the bearing tube at their lower forward ends. The upper rearward end of this connecting link assembly connects through the holes drilled in the parallel steel bars by way of a steel pin, as mentioned earlier, to the rotating effort arm assembly (assembly 2.0) at axis B, as shown in FIGS. 1 & 2. The lower forward end of this connecting link assembly connects down the axis of the bearing tube (part 4.2) by way of another steel pin, as mentioned earlier, to the rotating weight arm assembly (assembly 3.0) at axis D, as shown in FIGS. 1 & 2. The distance between the axes of connection on this connecting link assembly is 13.0", as shown in FIG. 3.

A weight arm support bracket (part 1.12) is welded to the machine's frame on the top side of the bottom section of part 1.1 in a position where it supports the machine's rotating weight arm (and therefore all of the machine's moving parts) in the starting position of the exercise movement.

HOW THE INVENTION WORKS

Like a typical pectoral fly machine, the exercising position is with the operator sitting on the seat support pad (part 7.2) with his back braced up against the back support and constraint pad (part 7.1) and with his hands raised above his elbows and the insides of his corresponding right and left upper arms engaging the back sides of the corresponding right and left upper arm engaging pads (parts $7.3_R$ & $7.3_L$). From this position the exercise is performed by contracting the pectoral muscles so as to move the arms forward against the upper arm engaging pads through circular paths about the vertical axes of rotation of the shoulder joints. Like a typical pectoral fly machine, the resistive force is applied to the operator's exercising upper arms by the two counter-rotating assemblies. Unlike a typical pectoral fly machine, which uses cables or chains to drive wheels or cam which are attached to the counter-rotating assemblies, this machine's counter-rotating assemblies (assemblies $5.0_R$ & $5.0_L$) are driven by the connecting links (parts $6.0_R$ & $6.0_L$) which are driven by the rotating effort arm assembly (assembly 2.0) which is driven by the connecting link assembly joining it to the rotating weight arm assembly (assembly 4.0) which is driven by the rotating weight arm assembly (assembly 3.0) which is driven by the force of gravity acting on the weights loaded at its distal end.

Figure 4:
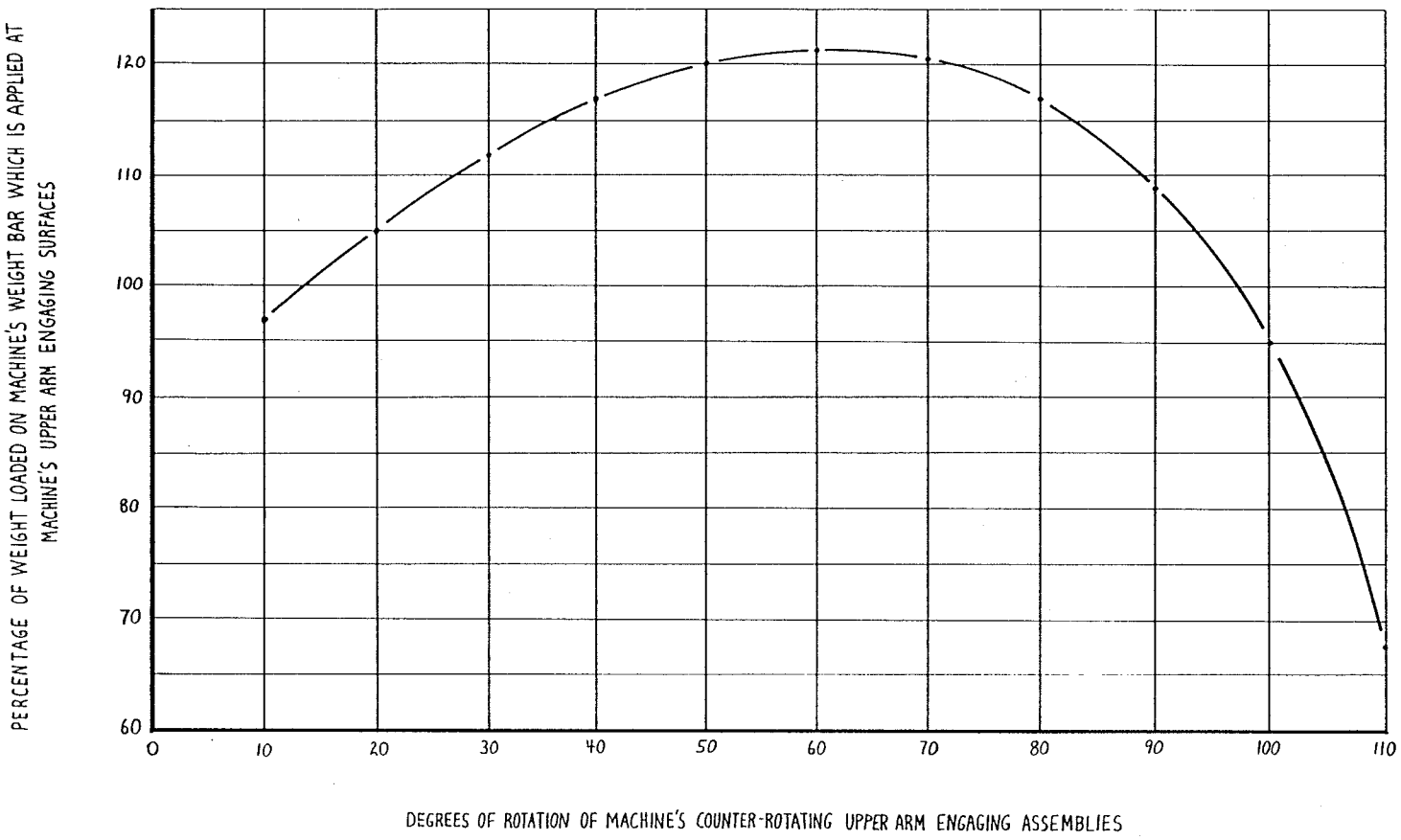
FIG. 4 is a graph generated from kinematic analysis of the machine's force-varying mechanism composed of the moving parts shown in FIG. 3.

Each counter-rotating assembly (assembly 5.0) and its connecting link (part 6.0) forms a crank and slider linkage. These crank and slider linkages are connected in series with the rotating effort arm (assembly 2.0), the rotating weight arm (assembly 3.0), the link joining them (assembly 4.0), and the frame of the machine (assembly 1.0) which form a four-bar linkage system. Together the lengths and orientations of the component members of the crank and slider linkages and the four-bar linkage's moving parts have been determined through kinematic analysis to apply, when acting in conjunction with the sinusoidally changing value of force applied by the machine's rotating weight arm as the weights swing through a circular path through the gravitational field, the predetermined variably resistive force shown in the graph in FIG. 4 at the upper arm engaging pads. As shown in the graph, the force applied at the machine's upper arm engaging surfaces, which corresponds to the normal strength-to-position force-applying capabilities of the average operator in the shoulder-joint horizontal-flexion exercise movement, varies as a function of the degrees of rotation of the machine's counter-rotating upper arm engaging assemblies.

CONCLUSION

This invention, through the use of only rigid drive members, applies a resistive force to an operator's shoulder-joint horizontal-flexion muscles without the use of cams, chains, or cables, as is conventional. Furthermore, by kinematically determining the specific lengths and orientations of the component members of this machine's moving parts, a variably resistive force is applied to the operator's exercising muscles which more closely corresponds to the normal strength-to-position force-applying capabilities of the average operator in the shoulder-joint horizontal-flexion exercise movement. Finally, this machine has only seven moving parts and ten pivotal joints making it inherently more reliable, less noisy, and more friction free than a comparable machine using cams, chains, or cables.

I claim:

1. An exercise machine for exercising the shoulder-joint horizontal-flexion muscles of an operator, comprising:

—a rigid frame including a base portion and an upstanding portion having a front, rear, top and bottom, wherein the bottom is rigidly secured to the base portion;

—an operator back constraint pad attached to the front side of said upstanding portion;

—an operator seat support pad attached to the front side of said upstanding portion in a position where it will engage the operator's seat while said operator is in a seated position of operation with his back engaging said back constraint pad;

—a pair of rigid counter-rotating assemblies mounted at the top of the front side of said upstanding portion so as to rotate about respective first and second substantially vertical axes, wherein said first substantially vertical axis is positioned to be coaxial with the vertical axis of rotation of said operator's right shoulder joint while said operator is in the operating position and said second substantially vertical axis is positioned to be coaxial with the vertical axis of rotation of said operator's left shoulder joint while said operator is in the operating position;

—said pair of rigid counter-rotating assemblies are comprised of respective cranks with offset arms which include respective contact surfaces for engaging the operator's respective right and left exercising upper arms while in said operating position;

—a rigid rotating effort arm assembly which is journaled to said frame to rotate about a first horizontal axis which is perpendicular with said first and second substantially vertical axes;

—a pair of rigid connecting links comprising slider linkages pivotally joining from the distal end of said rotating effort arm to respective pivotal points of connection on said respective counter-rotating assemblies in such a way that the respective counter-rotating assemblies rotate in opposite directions, thereby when said rotating effort arm assembly rotates toward said counter-rotating assemblies said pair of respective connecting links will cause said respective counter-rotating assemblies to rotate in opposite directions;

—a rigid rotating weight arm assembly which is journaled to said frame to rotate about a second horizontal axis which is both parallel with and separated by a specific distance from said first horizontal axis;

—said rotating weight arm assembly includes means for loading weights onto at a point offset from said second horizontal axis;

—said rotating effort arm assembly and said rotating weight arm assembly are mechanically linked to each other at third and fourth horizontal axes which are both parallel with and offset by specific distances from said first and second horizontal axes respectively, by a rigid connecting link which has a specific length between its centers of connection;

—said rotating effort arm assembly, said rotating weight arm assembly, said connecting link mechanically joining said rotating effort arm assembly to said rotating weight arm assembly, and said frame of said exercise machine join together to form a four-bar linkage system, which functions in conjunction with the rotating weight arm assembly and the crank and slider linkages constituted by the counter-rotating assemblies and their connecting links, to provide a variably resistive force at said upper arm engaging contact surfaces, which force varies as a function of the positions of said counter-rotating assemblies.

* * * * *